US006127912A

United States Patent [19]

Dust et al.

[11] Patent Number: 6,127,912

[45] Date of Patent: Oct. 3, 2000

[54] BOBBIN FOR AN ENCAPSULATED COIL OF A SOLENOID ASSEMBLY

[75] Inventors: Maurice J. Dust; John A. Hoffman, II, both of Peoria, Ill.

[73] Assignee: Caterpillar Inc., Peoria, Ill.

[21] Appl. No.: 09/127,838

[22] Filed: Aug. 3, 1998

[51] Int. Cl.[7] ..... H01F 27/02; H01F 27/30

[52] U.S. Cl. ..... 336/208; 336/198; 336/96

[58] Field of Search ..... 336/92, 96, 192, 336/208, 198

[56] References Cited

U.S. PATENT DOCUMENTS

| | | | |
|---|---|---|---|
| 4,682,136 | 7/1987 | Prokop | 335/282 |
| 4,701,999 | 10/1987 | Palmer | 437/211 |
| 5,281,940 | 1/1994 | Goto | 335/282 |
| 5,449,227 | 9/1995 | Steinberg et al. | 303/119.2 |
| 5,497,136 | 3/1996 | Wall | 335/299 |
| 5,508,671 | 4/1996 | Takashi | 335/296 |
| 5,524,334 | 6/1996 | Boesel | 29/605 |
| 5,527,117 | 6/1996 | Roy | 400/109.1 |
| 5,533,249 | 7/1996 | Wakeman | 29/605 |
| 5,538,220 | 7/1996 | LaMarca | 251/129.15 |
| 5,588,414 | 12/1996 | Hrytzak et al. | 123/571 |
| 5,589,808 | 12/1996 | Clark et al. | 336/92 |

FOREIGN PATENT DOCUMENTS

| | | |
|---|---|---|
| 7037718 | 2/1995 | Japan . |
| 1 207 329 | 11/1967 | WIPO . |

OTHER PUBLICATIONS

DuPont Engineering Plymers Product Information, "Electrical/Electronic Thermoplastic Encapsulation".

DuPont Engineering Polymers, "Coil Encapsulation with Thermoplastic Resins," Mark W. Wichmann, et al.

*Primary Examiner*—Michael L. Gellner
*Assistant Examiner*—Anh Mai
*Attorney, Agent, or Firm*—J. W. Burrows

[57] ABSTRACT

A bobbin for an encapsulated coil is provided for use in a coil assembly in which flange portions are provided on each end to ensure that during the process of encapsulating the coil with an over-molded material a positive seal is established between the bobbin and the over-molded material. Each of the flange portions have first, second, and third flange sections and each of the flange sections have predetermined diameters and peripheral surfaces that are angled with respect to a reference axis of a hole defined in the bobbin. The thin sharp edges formed by the peripheral surfaces of the respective flange sections melt back during the over-molding process. This melt back creates an intricate blend between the over-molded material and the bobbin thus producing a positive seal therebetween.

11 Claims, 3 Drawing Sheets

BOBBIN FOR AN ENCAPSULATED COIL OF A SOLENOID ASSEMBLY

TECHNICAL FIELD

The subject invention relates to a bobbin for an encapsulated coil of a coil assembly and more particularly to a bobbin of an encapsulated coil that provides a positive seal between the over-molded material and the bobbin during the molding process to prevent the ingression of moisture or other contaminants into the windings of the coil.

BACKGROUND ART

In known solenoid assemblies having encapsulated coils, a major problem encountered is providing the encapsulation around the coil so that moisture or other contaminants cannot reach the windings of the coil. Contaminants being exposed to the windings of the coil normally causes premature failure of the coil assembly. Failure of the coil assembly may cause a machine to be shut down until the coil assembly is replaced. Such shut down can be very costly to the owner of the machine. Various attempts have been made in the past to provide positive sealing of the over-molded material relative to the coil. Special emphasis has been placed on sealing between the over-molded material and the electrical leads extending from the coil to the exterior of the coil assembly. Likewise, various changes has been made to the over-molded material in order to help ensure that it bonds to the bobbin of the coil. This has proven to be helpful but many times creates other problems during the molding process. Most of the coil bobbins made in the past had square corners that proved to hamper the ability to ensure adequate sealing at the corners during molding of the over-molded material around the coil. One attempt that has proven to be helpful is to provide a tapered flange for sealing as opposed to a square cornered flange. The tapered sealing flange provides a thin portion at the edge of the taper that melts back during the molding process. A major problem with this type of bobbin is that the sharp, thin edge of the taper can easily be damaged during production and handling of the bobbin prior to the molding process. Any damage or crushing (large or small dent or impression on the sharp edge) of any part of the sharp, thin edge prior to the molding process provides a potential leakage path since the crushed or damaged portion may not effectively melt back during the molding process.

The present invention is directed to overcoming one or more of the problems as set forth above.

DISCLOSURE OF THE INVENTION

In one aspect of the present invention, a bobbin for an encapsulated coil of a coil assembly is provided. The bobbin includes a body and first and second flange portion circumscribed about the body. The body has first and second ends with a hole defined therein along a reference axis between the first and second ends. The first flange portion is located generally adjacent the first end and the second flange portion is located generally adjacent the second end. The first flange portion has a first flange section of a predetermined diameter with a peripheral surface that forms a predetermined angle with respect to the reference axis, a second flange section of a second predetermined diameter with a peripheral surface that forms a predetermined angle with respect to the reference axis, and a third flange section of a third predetermined diameter with a peripheral surface that forms a predetermined angle with respect to the reference axis. The second flange portion has a first flange section of a predetermined diameter with a peripheral surface that forms a predetermined angle with respect to the reference axis, a second flange section of a second predetermined diameter with a peripheral surface that forms a predetermined angle with respect to the reference axis, and a third flange section of a third predetermined diameter with a peripheral surface that forms a predetermined angle with respect to the reference axis.

BEST MODE FOR CARRYING OUT THE INVENTION

Figure 1:
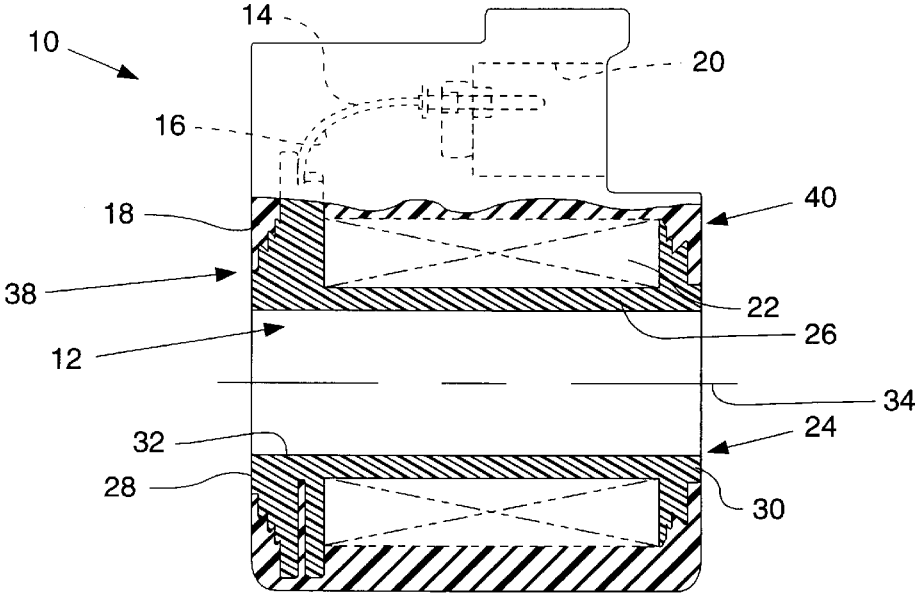
FIG. 1 is a diagrammatic representation of a coil assembly incorporating the subject invention.

Referring to the drawings and more particularly to FIG. 1, a coil assembly 10 is illustrated and includes an encapsulated coil 12, electrical leads 14,16 leading from the encapsulated coil 12, and an over-molded material 18. The over-molded material 18 is used to encapsulate the coil 12 and operative to protect the coil 12 from contaminants. The over-molded material 18 can be made from various known materials, such as various thermo-plastic or thermo-setting plastics. The over-molded material forms a protective covering or housing and has a recess 20 defined therein to receive an electrical plug (not shown) that mates with the leads 14,16 extending from the coil 12.

The coil 12 includes well known windings 22 and a bobbin 24. The bobbin 24 has a body 26 with first and second ends 28,30 and a hole 32 defined therein between the first and second ends 28,30 along a reference axis 34. The bobbin 24 has a first flange portion 38 circumscribed about the body 26 generally adjacent the first end 28 thereof and a second flange portion 40 circumscribed about the body 26 generally adjacent the second end 30 thereof. In a well known manner, the windings 22 are disposed about the body 26 between the first and second flange portions 38,40.

Figure 2:
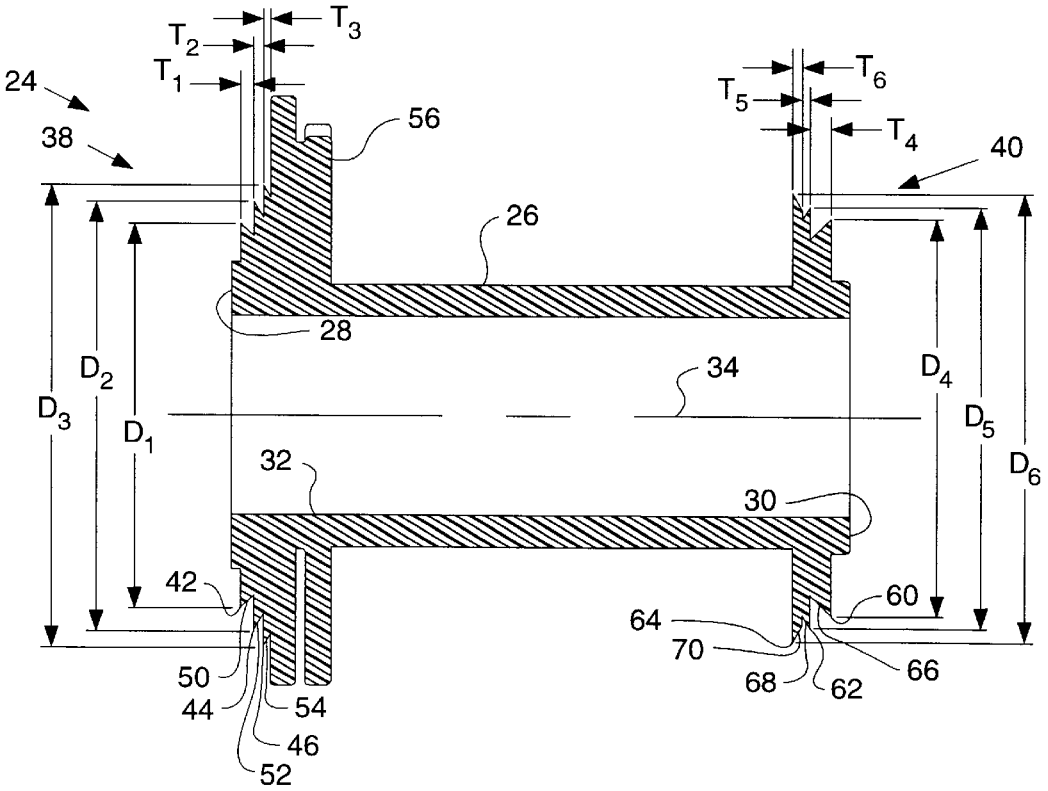
FIG. 2 is an enlarged view of an element illustrated in FIG. 1.
Figure 3:
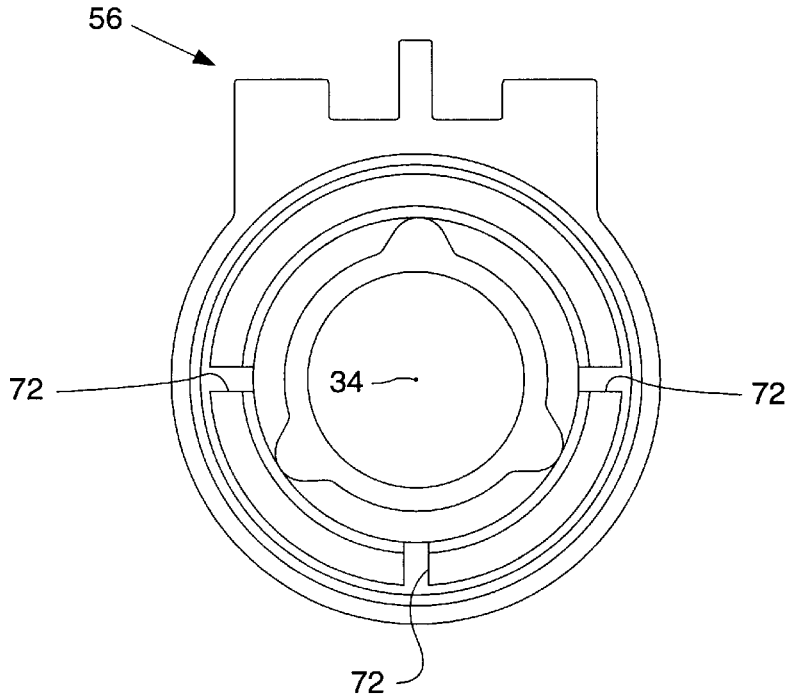
FIG. 3 is a left end view of the element of FIG. 2.
Figure 4:
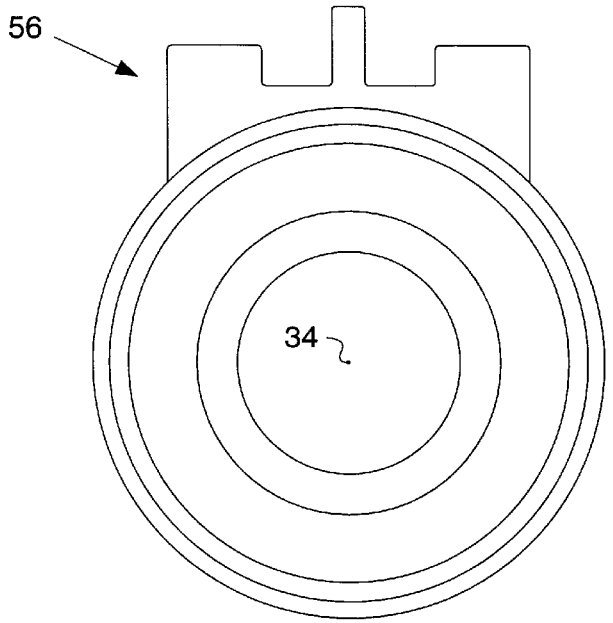
FIG. 4 is a right end view of the element of FIG. 2.

Referring to FIGS. 2–4 in conjunction with FIG. 1, an enlarged view of the bobbin 24 is illustrated. The first flange portion 38 has a first flange section 42, a second flange section 44 and a third flange section 46. The first flange section 42 is located generally adjacent the first end 28 of the body 26 and has a predetermined thickness "$T_1$" and a predetermined major diameter "$D_1$" with a peripheral surface 50 that forms a predetermined angle with respect to the reference axis 34. The predetermined angle being generally 45 degrees with the apex of the angle being towards the center of the body 26.

The second flange section 44 is located inwardly of the first end and adjacent the first flange section 42. The second flange section 44 has a predetermined thickness "$T_2$" and a predetermined major diameter "$D_2$" with a peripheral surface 52 that forms a predetermined angle with respect to the reference axis 34. The predetermined angle being in the range of 50–70 degrees and preferably about 60 degrees with the apex of the angle being towards the center of the body 26. The predetermined thickness "$T_2$" of the second flange section 44 being substantially the same as the predetermined thickness "$T_1$" of the first flange section 42. The predetermined diameter "$D_1$" of the first flange section 42 being less than the predetermined diameter "$D_2$" of the second flange section 44.

The third flange section 46 is located inwardly of the first end 28 and adjacent the second flange section 44. The third flange section 46 has a predetermined thickness "$T_3$" and a predetermined major diameter "$D_3$" with a peripheral surface 54 that forms a predetermined angle with respect to the reference axis 34. The predetermined angle being in the range of 50–70 degrees and preferably about 60 degrees with the apex of the angle being towards the center of the body 26. The predetermined thickness "$T_3$" of the third flange section 46 being substantially the same as the predetermined thickness "$T_2$" of the second flange section 44. The predetermined major diameter "$D_3$" of the third flange section 46 being greater than the predetermined major diameter "$D_2$" of the second flange section 44.

As more clearly illustrated in FIGS. 3 & 4, a projection 56 extends from the first flange portion 38 and is operative to route the electrical leads 14,16 from the windings 22.

The second flange portion 40 has a first flange section 60, a second flange section 62 and a third flange section 64. The first flange section 60 is located generally adjacent the second end 30 of the body 26 and has a predetermined thickness "$T_4$" and a predetermined major diameter "$D_4$" with a peripheral surface 66 that forms a predetermined angle with respect to the reference axis 34. The predetermined angle being generally 45 degrees with the apex of the angle being towards the center of the body 26.

The second flange section 62 of the second flange portion 40 is located inwardly of the second end and adjacent the first flange section 60. The second flange section 62 has a predetermined thickness "$T_5$" and a predetermined major diameter "$D_5$" with a peripheral surface 68 that forms a predetermined angle with respect to the reference axis 34. The predetermined angle being in the range of 50–70 degrees and preferably about 60 degrees with the apex of the angle being towards the center of the body 26. The predetermined thickness "$T_5$" of the second flange section 62 being less than the predetermined thickness "$T_4$" of the first flange section 60. The predetermined diameter "$D_4$" of the first flange section 60 being less than the predetermined diameter "$D_5$" of the second flange section 62.

The third flange section 64 of the second flange portion 40 is located inwardly of the second end 30 and adjacent the second flange section 62 thereof. The third flange section 64 has a predetermined thickness "$T_6$" and a predetermined major diameter "$D_6$" with a peripheral surface 70 that forms a predetermined angle with respect to the reference axis 34. The predetermined angle being in the range of 50–70 degrees and preferably about 60 degrees with the apex of the angle being in a direction away from the second end 30. The predetermined thickness "$T_6$" of the third flange section 64 being substantially the same as the predetermined thickness "$T_5$" of the second flange section 62. The predetermined major diameter "$D_6$" of the third flange section 64 being greater than the predetermined major diameter "$D_5$" of the second flange section 62.

Referring more closely to FIG. 3, the second and third flange sections 44,46 of the first flange portion 38 are clearly illustrated as being continuously solid all the way around. However, the first flange section 42 thereof is illustrated as being broken into segments by the slots 72. It is recognized that the slots 72 may not be needed but do aid in the mold process. In FIG. 4, each of the first, second, and third flange sections 60,62,64 of the second flange section 40 is continuously solid all the way around.

Figure 5:
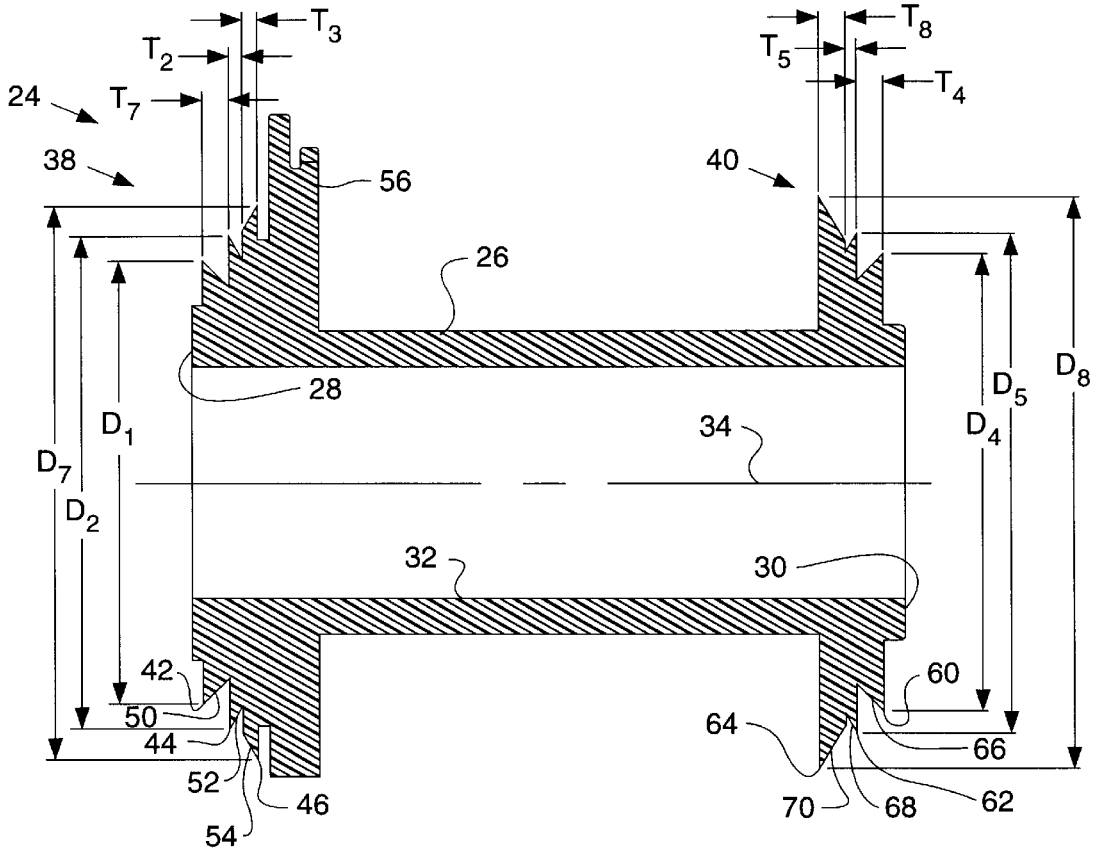
FIG. 5 is an enlarged view of another embodiment of the element illustrated in FIG. 2.

Referring to FIG. 5, another embodiment of the bobbin 24 is illustrated. Like elements have like element numbers. The differences between the embodiment of FIG. 5 as compared to the embodiment of FIG. 2 is hereinafter described. The first flange section 42 of the first flange portion 38 has a predetermined thickness "$T_7$" that is larger than the predetermined thickness "$T_2$" of the second flange section 44 thereof. Additionally, the third flange section 46 has a predetermined major diameter "$D_7$" that is larger than the equivalent predetermined major diameter "$D_3$" of FIG. 2 due to the fact that the apex of the angle of the peripheral surface 46 of the third flange section 46 extends outward away from the first end 28.

The third flange section 64 of the second flange section 40 has a predetermined thickness "$T_8$" that is larger than the predetermined thickness "$T_5$" and a predetermined major diameter "$D_8$" that is larger than the equivalent predetermined major diameter "$D_6$" of FIG. 2 due to the fact that the thickness thereof is larger and the angle of the peripheral surface 46 remains the same. All other aspects of the bobbin 24 of the alternate embodiments remains the same.

It is recognized that various modifications could be utilized herein without departing from the essence of the subject invention. The following are some examples of such modifications but is not intended to be a comprehensive list. It is recognized that the relative sizes of the various flanges sections could vary. Likewise, it is recognized that more than three flange sections could be used in each one or both of the first and second flange portions 38,40. Even though it is illustrated and described that the third flange section of each of the first and second flange portions 38,40 is larger than the other two flange section, it is recognized that any one of the three flange sections in each flange portion could be larger than the other two.

INDUSTRIAL APPLICABILITY

The structure of the bobbin 24 of the subject coil assembly 10 provides a lock and a positive seal between the bobbin 24 and the over-molded material 18 during the molding process which encapsulates the coil 12. It is important to ensure that the bobbin 24 and the over-molded material 18 do not move relative to each other. The lock is provided by the first flange sections 42,60 of the first and second flange sections 38,40. The respective peripheral surfaces 50,66 being angled at generally 45 degrees provides a lock in a direction along the reference axis 34 while the slots 72 in the first flange section 38 provides a lock to inhibit any rotary movement between the bobbin 24 and the over-molded material 18.

In order to provide a positive seal between the bobbin 24 and the over-molded material 18, it is necessary to ensure that a bond is made therebetween. The second flange sections 44,62 of the first and second flange portions 38,40 serve to provide a bond between the bobbin 24 and the over-molded material 18. This is accomplished by providing a relative thin, sharp edge entirely around the periphery thereof. This relative thin sharp edge is provided by having the respective peripheral surfaces 52,68 angled with respect to the reference axis 34. Preferably the angle is about 60 degrees with the reference axis 34. During the molding process, the relative thin, sharp edge melts from the heat of the injected over-molded material 18. As the over-molded material 18 and the material of the bobbin 24 at the thin, sharp edge solidifies, an integral bond is established. This bond between the bobbin 24 and the over-molded material 18 serves as a first barrier to the ingression of contaminants.

The third flange sections 46,64 of the first and second flange portions 38,40 also serve to provide a bond between the bobbin 24 and the over-molded material 18 in the same manner. The relatively thin, sharp edge provided by the respective angled peripheral surfaces 46,64 melt during the molding process and bonds with the over-molded material 18 as the injected over-molded material 18 solidifies. This bond between the bobbin 24 and the over-molded material 18 serves as a second barrier to the ingression of contaminants.

The second barrier is very important since any damage (dents, voids, etc.) to the thin, sharp edges of either of the second flange sections 44,62 that establish the first barrier could result in a leak path for contaminants to enter the coil 12. Any damage to the thin, sharp edges may inhibit the melting of the respective edges at the location of the damage. If the material of the bobbin 24 does not melt during the molding process, a positive bond or seal may not occur and contaminants may have a path to enter the coil 12 and cause premature failure of the coil assembly 10.

The respective third flange sections 46,64 not only provides thin, sharp edges to establish a second barrier to contaminants during the molding process, they also provide protection to the respective second flange sections 44,62. Since the bobbins 24 are mass produced, it is difficult to protect the respective thin, sharp edges. The structure of the first and second flange portions 38,40 serves to provide a degree of protection to the bobbins 24 during their production and subsequent handling.

By having the diameters of the respective second flange sections 44,62 smaller than the diameters of the respective third flange sections 46,64, there is less tendency of the thin, sharp edges of the second flange sections being damaged during production and subsequent handling. If a portion of one of the respective second flange sections 44,62 is damaged, the third flange section 46,64 serves to inhibit the ingression of contaminants therethrough. It is recognized that the respective diameters of the first, second, and third flange section of each of the first and second flange portions 38,40 could be varied without departing from the essence of the subject invention. Preferably, the diameters of the second and third flange sections should be different in order to protect at least one of them from damage.

In view of the foregoing, it is readily apparent that the structure of the present invention provides a bobbin 24 for an encapsulated coil 12 that functions during the process of encapsulating the coil 12 to provide a positive seal between the bobbin 24 and the over-molded material 18. The positive seal is provided by having at least two flange sections of different diameters so that one serves to protect the other from damage during production and subsequent handling. The structure of the bobbin 24 also serves to provide a lock between the bobbin 24 and the over-molded material 18.

We claim:

1. A bobbin for an encapsulated coil of a coil assembly, the bobbin comprising:

a body having first and second ends with a hole defined along a reference axis therethrough between the first and second ends;

a first flange portion circumscribed about the body and located generally adjacent the first end, the first flange portion having a first flange section of a predetermined diameter with a peripheral surface that forms a predetermined acute angle with respect to the reference axis, a second flange section of a second predetermined diameter that is larger than the predetermined diameter of the first flange section and having a peripheral surface that forms a predetermined acute angle with respect to the reference axis, and a third flange section of a third predetermined diameter that is larger than the predetermined diameter of the second flange section and having a peripheral surface that forms a predetermined acute angle with respect to the reference axis; and a second flange portion circumscribed about the body and located generally adjacent the second end, the second flange portion has a first flange section of a predetermined diameter with a peripheral surface that forms a predetermined acute angle with respect to the reference axis, a second flange section of a second predetermined diameter that is larger than the predetermined diameter of the first flange section of the second flange portion and having a peripheral surface that forms a predetermined acute angle with respect to the reference axis, and a third flange section of a third predetermined diameter that is larger than the predetermined diameter of the second flange section of the second flange portion and having a peripheral surface that forms a predetermined acute angle with respect to the reference axis.

2. The bobbin set forth in claim 1 wherein the angle formed by the peripheral surface of the second flange section of the first and second flange portions is in the range of fifty to seventy degrees with respect to the reference axis.

3. The bobbin of claim 2 wherein the angle of the periphery surface formed by the peripheral surface of the second flange section of the first and second flange portions is generally sixty degrees with respect to the reference axis.

4. The bobbin of claim 3 wherein the angle formed by the peripheral surface of the third flange section of the first and second flange portions is in the range of fifty to seventy degrees with respect to the reference axis.

5. The bobbin of claim 4 wherein the angle of the periphery surface formed by the peripheral surface of the third flange section of the first and second flange portions is generally sixty degrees with respect to the reference axis.

6. The bobbin of claim 5 wherein the thickness of the first flange section of the first and second flange portions is greater than the thickness of the second flange section of the first and second flange portions.

7. The bobbin of claim 6 wherein the peripheral surfaces of the first flange section of the first flange portion and the first flange section of the second flange portion are angled with respect to the reference axis at an angle of substantially forty-five degrees.

8. The bobbin of claim 5 wherein the apex of the angle of the respective peripheral surfaces of the first and second flange sections of the second flange portion with respect to the reference axis is towards the center of the body.

9. The bobbin of claim 8 wherein the peripheral surface of the third flange section of the second flange portion angles in a direction opposite to the direction of angle of the peripheral surfaces of the first and second flange sections thereof.

10. The bobbin of claim 5 wherein the apex of the angle of the respective peripheral surfaces of the first, second and third flange sections of the first flange portion with respect to the reference axis is towards the center of the body.

11. The bobbin of claim 5 wherein the peripheral surface of the third flange section of the first flange portion angles in a direction opposite to the direction of angle of the peripheral surfaces of the first and second flange sections thereof.

* * * * *